US005623889A

United States Patent [19]

Whitener

[11] Patent Number: 5,623,889

[45] Date of Patent: Apr. 29, 1997

[54] MOORING AND RAMP SYSTEM FOR FERRY BOATS

[76] Inventor: Philip C. Whitener, 5955 Battlepoint Dr., Bainbridge Island, Wash. 98110

[21] Appl. No.: 528,615

[22] Filed: Sep. 15, 1995

[51] Int. Cl.[6] ..... B63B 21/00

[52] U.S. Cl. ..... 114/230; 114/258

[58] Field of Search ..... 114/258, 220, 114/230, 231; 414/140.1; 14/69.5, 71.1, 71.5, 71.7; 440/35; 405/213

[56] References Cited

U.S. PATENT DOCUMENTS

| | | | |
|---|---|---|---|
| 768,765 | 8/1904 | MacLean | 114/231 |
| 1,913,207 | 6/1933 | McDougall | 114/72 |
| 3,069,862 | 12/1962 | Ward | 114/231 |
| 3,320,918 | 5/1967 | Zalejski | 114/230 |
| 3,326,171 | 6/1967 | Zade | 114/220 |

FOREIGN PATENT DOCUMENTS

| | | | |
|---|---|---|---|
| 258048 | 1/1971 | U.S.S.R. | 114/230 |

*Primary Examiner*—Edwin L. Swinehart
*Attorney, Agent, or Firm*—Robert W. Jenny

[57] ABSTRACT

The subject system includes a ramp subsystem and a mooring subsystem and is intended for use with multi deck ferry boats with ramp service directly to each deck. The ramp subsystem is carried on a float which is connected to the shore by a ramp hinged to the shore and to the float. A second ramp is hinged on the float and is adjustable to serve each deck of a multi deck boat in sequence. In an alternate embodiment there are as many decks on the float as there are decks on the boats and no adjustment is needed. The mooring subsystem involves mechanism which connects an end of the boat to the float and allows lateral translation of the boat relative to the float, enabling the boat to be moored at one location on the float for unloading and to be moved to a second location for loading. This allows for one boat to be loading while a second is unloading simultaneously. There is a mooring mechanism at each side of the end of the boat and each mechanism includes at least one roller at a fixed center which engages one face of the rail and at least one roller controllable to engage and disengage the opposite face of the rail.

2 Claims, 2 Drawing Sheets

MOORING AND RAMP SYSTEM FOR FERRY BOATS

BACKGROUND OF THE INVENTION

1. Field

The subject invention is in the fields of equipment and apparatus used for mooring boats and ships and of facilities used for loading and unloading what is carried by the vessels, i.e. the payloads, in particular vehicles and passengers. More particularly, it is in these fields as applicable to ferry boats for which it is especially important that mooring, loading and unloading be done expeditiously.

2. Prior Art

With the conventional prior art in these fields, as applied to ferry boats, the boats come into the dock end first guided by pilings or wingwalls, are held in place by mooring lines and/or vessel propulsion, and a ramp hinged on the dock facility is lowered to the main deck of the boat for unloading payload and then raised before the boat departs. The ramps are usually no more than two vehicle lanes wide while the decks of the boats are often several lanes wide. This situation sets up requirements that the boat be fitted with inter-deck ramps and that deck space be devoted specifically to provision for convergence of the several lanes to the one or two used for loading and unloading. Meeting these requirements limits the number of decks which can be feasibly used and lowers the ratio of payload space to total deck space of the boats using such mooring and ramp systems, thus limiting the traffic flow rate capability of the ferry system, especially relative to the speeds and displacements of the boats used in the system. A second aspect of conventional mooring and ramp systems which limits the traffic flow rate capability is that each boat must be unloaded and loaded in sequence, requiring significantly more time per turn around than would be required if loading and unloading were done simultaneously.

Accordingly, the primary objective of the subject invention is that it enhance the traffic flow rate capability of a ferry system. Secondary objectives which contribute to achieving meeting the primary objective are that: (1) the mooring and ramp system be unaffected by changes in water level caused by tides or other factors, (2) the mooring and ramp system facilitates simultaneous loading and unloading of boats, and (3) it facilitates use of multi-deck ferry boats.

SUMMARY OF THE INVENTION

The subject invention is a mooring and ramp system for ferry boats, particularly those having a plurality of decks with each deck comprising a plurality of straight lanes. In one embodiment of the subject system a hinged ramp serves the full width of each deck in sequence. In other embodiments two or more independent ramps may be used. The ramp facility is mounted on a float so that its operating level suits that of the ferry boats regardless of changes in water level caused by tides. The float is connected by a ramp to the shore based portion of the system, the ramp being hinged at both ends. Also, the mooring is done mechanically using powered mechanism which can accommodate and/or cause lateral movement of the moored boat along with vectored thrust and state of the art instrumentation to enable bringing the boat in without external assistance. In this system, once a boat is unloaded it is moved laterally to a position in which it is loaded while another boat moves into the unloading position. Thus, loading and unloading occur essentially simultaneously. The mechanical mooring assures precise relative positioning of the ramp and decks, and also allows lateral movement of the boat for ramp alignment after the boat is moored, thus reducing the precision required in docking the boat.

The mooring mechanism comprises heavy duty tired wheels or rollers, some of which are powered to cause the lateral movement. Some of the wheels/rollers are on fixed axles, some are mechanically adjusted to effect engagement and disengagement of the boat and mooring facility. The wheels/rollers may all be mounted on and powered from either the mooring facility or the boat or may be divided between the two. Alternately, the wheels/rollers may be used for engagement and guidance only with the power being provided by a conveyor chain or the like.

In an alternate embodiment of the subject invention the ends of the boat are arc shaped, lateral motion of an end turns the boat about its vertical center and the docking configuration allows loading from one end of the boat while unloading from the other end. In this embodiment the docking facility is multi-deck to match the boats that use it and no ramps are required on the float.

The invention is described in more detail below with reference to the attached drawings.

DETAILED DESCRIPTION OF THE INVENTION

Figure 1:
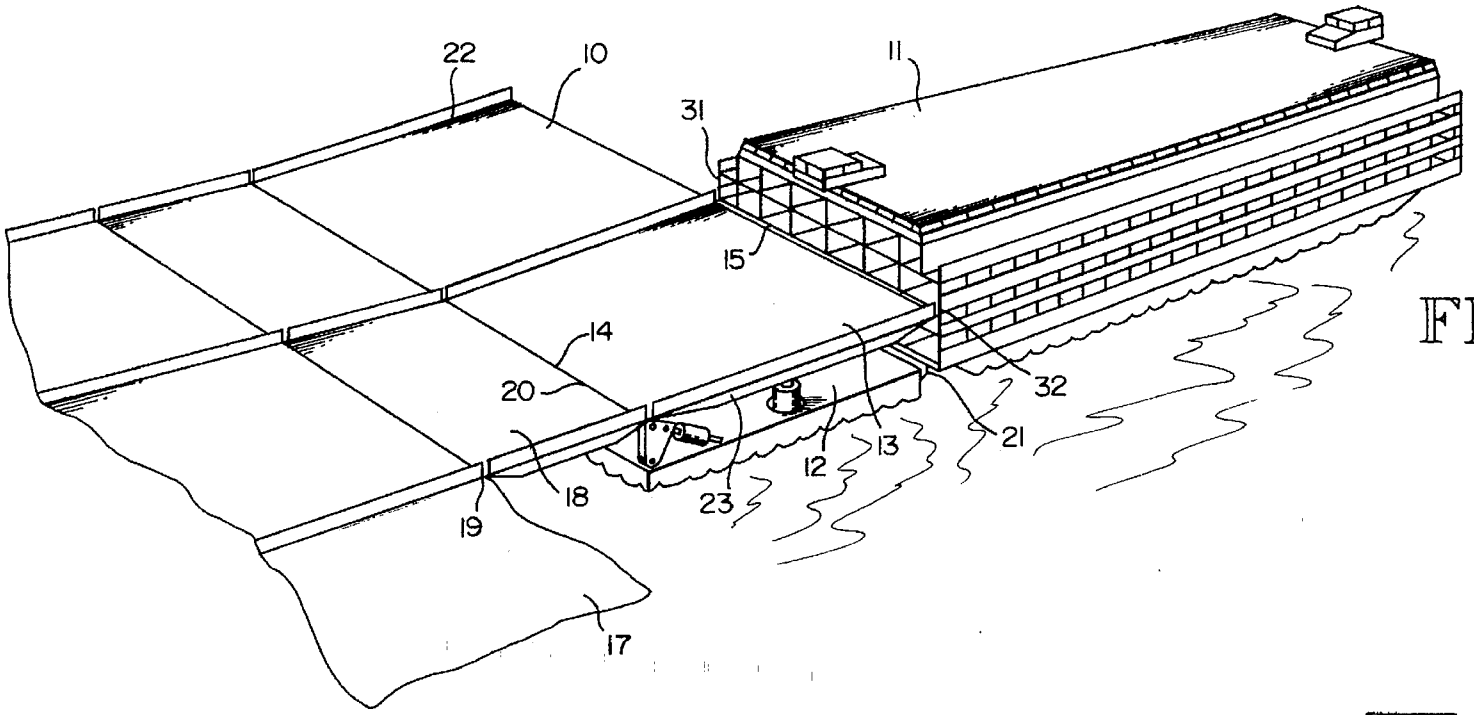
FIG. 1 is a general, semi-schematic view of a ferry boat, configured to suit the subject system, moored to the subject system.

The subject invention is a mooring and ramp system for use with ferry boats. FIG. 1 illustrates the subject ramp subsystem 10 with a ferry boat 11, configured to suit the subject system, moored to the ramp system. The ramp subsystem comprises a float 12, a ramp 13 hinged to the float at 14. End 15 of the ramp is raised and lowered to be positioned at the ends of the various decks of the boat, deck 16 being typical. In use the ramp serves one deck at a time, in sequence. The float is connected to the shore 17 by ramp 18 which is hinged to the shore at 19 and to the float at 20. The boat is moored to the float by a subsystem described below which attaches the boat to the float at rail 21 which extends across the float.

In use a boat moors near one end 22 of the float and is unloaded in that position. It then is moved laterally to near end 23 of the float, in which position it is loaded while a boat taking its vacated position is unloaded. The lateral movement is accomplished by the mooring subsystem, assisted, if necessary, by thrusters on the boat.

Figure 2:
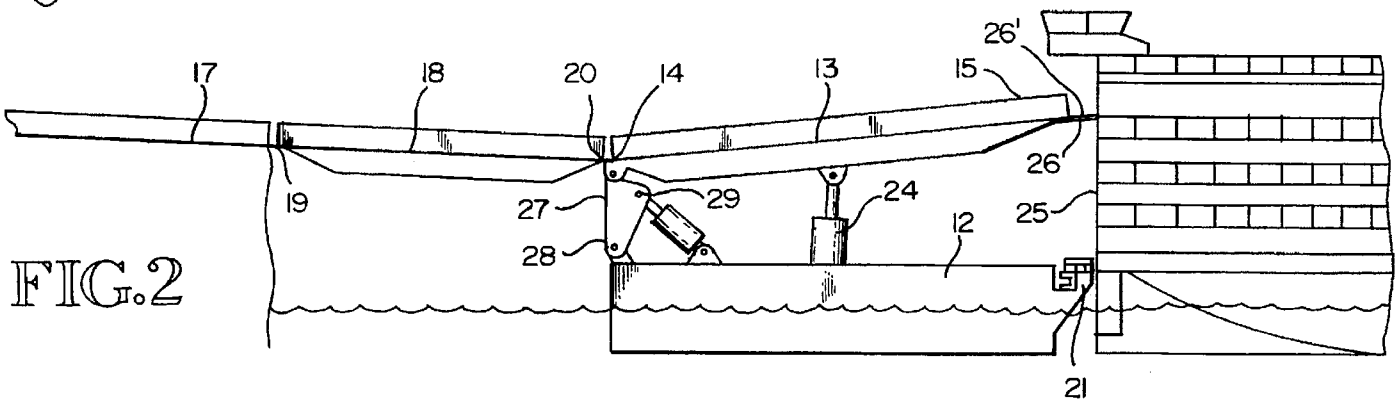
FIG. 2 is a schematic end view of the ramp subsystem.

FIG. 2 is a schematic end view of the ramp subsystem with parts numbered as in FIG. 1. Hydraulic actuators, actuator 24 being typical, position ramp 13. The end 25 of the boat can be contoured to accommodate the arcuate path of edge 26 of ramp 13 or a portion of edge 26 and be made telescopic to eliminate any significant gaps between the ramp and decks or support 27 can be pivoted to the float at 28 and activated at point 29 to produce vertical straight line motion of edge 26. Portion 26' of the ramp may be hinged to allow rotating it upward to function as a pedestrian and vehicle restraint rail.

Figure 3:
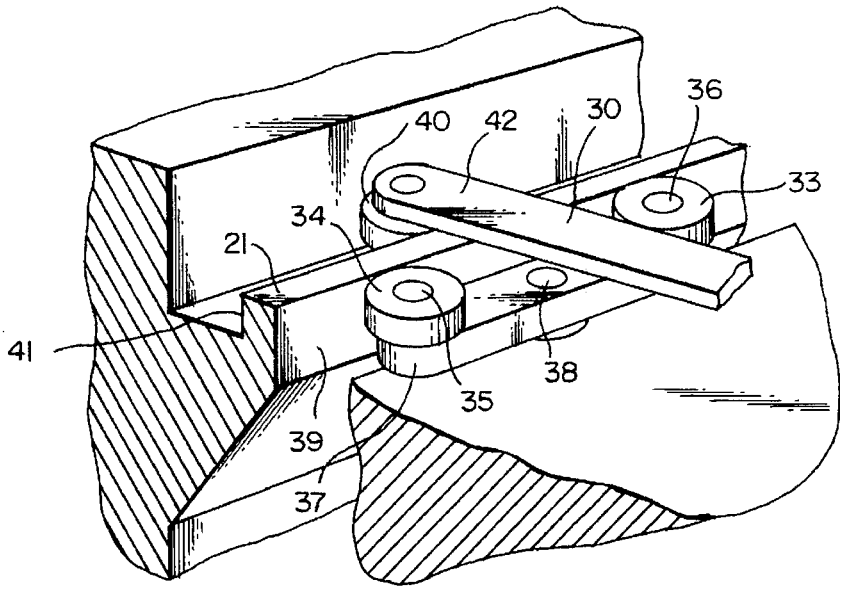
FIG. 3 is a schematic view of one embodiment of a mechanized mooring subsystem.

FIG. 3 illustrates schematically one embodiment of a mechanized mooring subsystem. The boat is moored by one such mechanism 30, attached to the main deck of the boat near one side 31 of the boat and another at side 32 of the boat (FIG. 1). Rollers 33 and 34 are pivoted at 35 and 36 on beam 37 which is pivoted on boat structure at 38. Rollers 33 and 34 contact surface 39 on rail 21 as the boat moves against the rail. Roller 40 is then positioned to engage surface 41 on rail 21, roller 40 being pivoted to beam 42 which is activated to so position roller 40 and press it against surface 41. This mechanism will incorporate shock absorbing will allow considerable tolerance in the boat speed approaches the ramp system.

Rollers 33 and 34 are hydraulic powered to rotate and rotating them provides the lateral translation of the boat relative to the ramp.

In an alternate embodiment of the invention the rollers are not powered and translation of the boat relative to the ramp is effected by a chain such as is used on conveyor systems mounted on the ramp and disengageably engaged by hooks or pawls on the boat.

Figure 4:
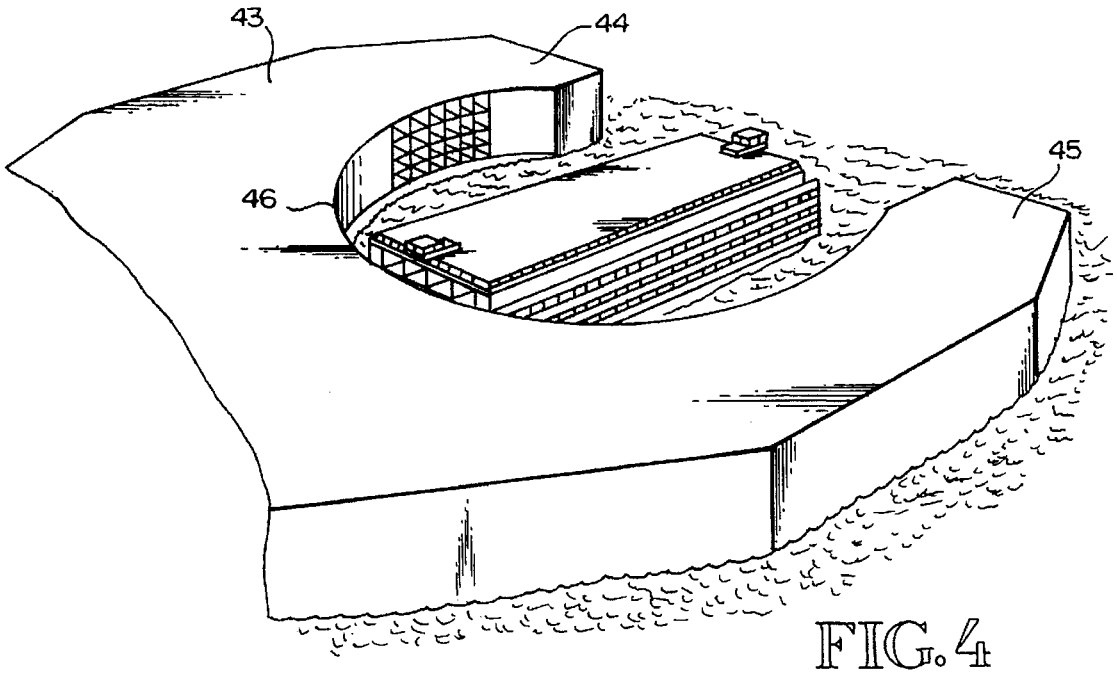
FIG. 4 is a general view of an alternate dock configuration employing the subject mooring subsystem.

FIG. 4 illustrates an alternate dock configuration employing the subject mooring subsystem. Dock 43 is a floating facility and has two arms 44 and 45 enclosing and joined by an arc shaped mooring contour 46. In this configuration a boat enters the area between the arms and moors to the dock at the location 46 between the two arms. The moored end of the boat is then translated along the contour by the mooring subsystem, causing the boat to rotate about its center 90° so that each end of the boat is moored to an arm of the dock. The dock has as many decks as the boat and, once the boat is fully moored, traffic can leave the boat from one end of the boat as new traffic moves onto the boat at the other end. Once the loading and unloading are complete the boat is rotated 90° again and leaves the dock. Using two such docks and an appropriate number of boats would allow a virtually continuous flow of traffic into and out of the docking facility. Also, this facility allows use of boats which are single directional.

It is considered to be understandable from this description that the subject invention meets its objectives. It provides a mooring and ramp system which can significantly enhance the traffic flow rate capability of a ferry boat system. The system is not affected by changes in water level caused by tides or other factors. It enhances the feasibility of ferry docking facilities in which traffic flow direction in all lanes is always in the same direction, i.e. traffic inflow and outflow are independent of each other and boat loading and unloading can occur simultaneously. It also facilitates the use of multi deck ferry boats.

It is also considered to be understood that while certain embodiments of the subject invention are disclosed herein, other embodiments and modifications of those disclosed are possible within the scope of the invention which is limited only by the attached claims.

I claim:

1. A mooring and ramp system for use with ferry boats, each of said boats having an end, a first side and a second side, and a plurality of decks for transporting vehicles, said system comprising a mooring subsystem and a ramp subsystem, said ramp subsystem comprising means for providing access for said vehicles to each of said decks, said mooring subsystem comprising means for detachably attaching said end of each of said boats to said ramp subsystem, said means for attaching allowing lateral movement of said boat relative to said ramp subsystem, said mooring subsystem further comprising means for moving said boat laterally relative to said ramp subsystem.

2. The system of claim 1 in which said means for attaching said end comprises a plurality of rollers and said means for moving said boat further comprises means for powering at least one of said rollers.

* * * * *